US005476043A

United States Patent [19]

Okuda et al.

[11] Patent Number: 5,476,043

[45] Date of Patent: Dec. 19, 1995

[54] METHOD AND DEVICE FOR POST-PROCESSING A PRINTED IMAGE IN A PRINTING DEVICE

[75] Inventors: Sadanao Okuda; Takahito Tojima; Takashi Isozaki, all of Tokyo, Japan

[73] Assignee: Riso Kagaku Corporation, Tokyo, Japan

[21] Appl. No.: 301,819

[22] Filed: Sep. 7, 1994

[30] Foreign Application Priority Data

Sep. 16, 1993 [JP] Japan ..... 5-230191

[51] Int. Cl.[6] ..... B41M 7/00

[52] U.S. Cl. ..... 101/483; 101/416.1; 101/424.2; 118/46

[58] Field of Search ..... 101/117, 118, 101/114, 129, 416.1, 417, 418, 423, 424, 425, 424.2, 483; 427/333; 118/46, 56, DIG. 1

[56] References Cited

U.S. PATENT DOCUMENTS 3,861,351 1/1975 Bonwit et al. ..... 101/424.2 X
4,836,129 6/1989 Dahlgren ..... 101/424.2

OTHER PUBLICATIONS

Patent Abstracts of Japan, vol. 18, No. 154 (M-1577) 15 Mar. 1994 (JP-A-5330016) 14 Dec. 1993.

*Primary Examiner*—Chris A. Bennett
*Attorney, Agent, or Firm*—Dickstein, Shapiro & Morin

[57] ABSTRACT

The occurrence of offsetting and strike-through in a stencil printing device is prevented without creating any new problems, and the printing paper is allowed to be conveyed with a pair of rollers interposing the printing paper for a reliable paper ejection process. Printing paper P is passed through a nip between a contact roller 37 and a counter roller 39 opposing the contact roller 37, the outer circumferential surface of the contact roller being coated with a layer of excess ink removing liquid which does not dissolve with the printing ink forming the printed image and has smaller surface tension than the printing ink, and the contact between the excess ink removing liquid layer a of the contact roller 37 and the printed surface of the printing paper P causes the excess portion of the printing ink b deposited on the printed image of the printing paper to be transferred onto the excess ink removing liquid layer a so as to remove the excess ink from the printing paper P. The contact roller may be replaced with an endless contact belt 83.

20 Claims, 6 Drawing Sheets

METHOD AND DEVICE FOR POST-PROCESSING A PRINTED IMAGE IN A PRINTING DEVICE

TECHNICAL FIELD

The present invention relates to a method and a device for post-processing a printed image for use in a printing device such as a stencil printing device, and in particular to a method and a device for post-processing a printed image which can prevent offsetting and strike-through.

BACKGROUND OF THE INVENTION

In the printing process using printing ink of a liquid form, when printing paper sheets are stacked one over the other immediately after printing, the printing ink deposited on one sheet of printing paper may adhere to the overlying sheet of printing paper, or so-called offsetting may occur. Also, if the printed image is touched by a finger or the like immediately after printing, the printed image may be smeared. If the deposited ink is excessive, the ink may penetrate the printing paper, and may show on the other side of the paper sheet or, in other words, strike-through may occur. These problems are particularly serious in stencil printing where the amount of ink or the ink deposit for forming the printed image on the printing paper is relatively great.

Conventionally, to avoid the occurrence of offsetting and strike-through, various measures have been taken, such as reducing the amount of ink deposit for forming a printed image on the printing paper during the printing process, and speeding up the drying of the printing ink by heating the printing ink deposited on the printing paper.

When printing paper is conveyed to an ejected paper tray or a sorter upon completion of printing, the conveying rollers cannot engage the front face of the printing paper with printing ink deposited thereon because the printed image must be protected from contact. Therefore, conventionally, printing paper was conveyed without touching the front face of the printing paper carrying the printed image by using a conveying mechanism such as a belt conveyor which acts only upon the reverse surface (the face not carrying any printed image) of the printing paper. Such a printing paper conveying device is disclosed, for instance, in Japanese patent laid open (kokai) publication No. 50-88769.

Attempts to prevent offsetting and strike-through in the printing process by reducing the amount of ink deposit give rise to Various problems. Controlling the amount of ink deposit so as to prevent strike-through is highly difficult, and excessive reduction in the amount of ink deposit causes degradation of image quality, such as insufficiency in print density.

Attempts to prevent offsetting and strike-through by drying the printing ink also cause various problems. Because the process of drying the printing ink has to be completed in a short time period while the printing paper is being ejected out of the printing device, and a heater having a relatively large capacity is required. This problem becomes progressively more pronounced as the printing speed increases. From a practical point of view, it is not possible to dry the printing ink in a short time period to a sufficient extent to prevent the occurrence of strike-through.

When printing paper is conveyed without touching the printed surface of the printing paper, the capability to stack the printing paper in a neat fashion on the paper ejection tray and the sorter cannot be attained so easily as in the case of the normal PPC (plain paper copier) or the like in which the copy paper is fed by contacting each sheet from two sides. This also becomes more pronounced as the printing speed or, in other words, the paper ejecting speed increases. Furthermore, the freedom in selecting the path of ejecting printing paper is more restricted.

BRIEF SUMMARY OF THE INVENTION

In view of such problems of the prior art, a primary object of the present invention is to provide a method for post-processing a printed image in a printing device which can effectively eliminate offsetting and strike-through without creating any new problems.

A second object of the present invention is to provide a method for post-processing a printed image in a printing device which can prevent the printed image from being smeared even when the printed image is rubbed by a finger or the like immediately after the printing paper is ejected.

A third object of the present invention is to provide a method for post-processing a printed image in a printing device which can allow the printing paper to be conveyed in the paper ejecting process by using a pair of rollers which interpose the printing paper therebetween.

A fourth object of the present invention is to provide a method for post-processing a printed image in a printing device which would not restrict the freedom in selecting the path of ejecting printing paper.

A fifth object of the present invention is to provide a device for post-processing a printed image which can be used for carrying out such a method.

These and other objects of the present invention can be accomplished by providing a method for post-processing a printed image in a printing device, comprising the steps of: coating a layer of excess ink removing liquid on a contact surface of a contact member; contacting a printed surface of printing paper with the contact surface coated with the excess ink removing liquid layer, the excess ink removing liquid having a property not to mutually dissolve with printing ink forming the printed image, and having a lower surface tension than printing ink deposited on the printed surface; and removing excess printing ink from the printed surface by transferring an excess portion of the printing ink deposited on the printed surface onto the excess ink removing liquid layer coated on the contact surface.

The contact surface may be defined by an outer circumferential surface of a contact roller, and the excess ink removing liquid layer formed on the outer circumferential surface of the contact roller may be brought into contact with the printed surface of the printing paper by passing the printing paper through a nip between the contact roller and a counter roller opposing the contact roller. Alternatively, the contact surface may be defined by an outer belt surface of an endless belt passed around a plurality of rollers, and the excess ink removing liquid layer formed on the belt surface of the endless belt may be brought into contact with the printed image surface of the printing paper by passing the printing paper through a nip between the endless belt and a counter roller opposing the endless belt.

Thus, the excess ink removing liquid surface defined by the contact surface typically consisting of the outer circumferential surface of a contact roller or the belt surface of an endless contact belt contacts the printed image on the printing paper with a layer of excess ink removing liquid, and this contact causes any excess ink deposited on the printed image of the printing paper to be transferred onto the excess ink removing liquid layer so as to remove the excess printing ink from the printing paper.

Because the excess printing ink removing liquid forming the excess ink removing liquid layer does not mutually dissolve with the printing ink forming the printed image, and its surface tension is less than that of the printing ink, the printing ink transferred onto the excess ink removing liquid layer remains physically separated from the excess ink removing liquid of the excess ink removing liquid layer by floating on it. Therefore, by using cleaning means such as a scraper which engages the excess ink removing liquid surface, the excess ink removing liquid surface can be readily refreshed or the transferred ink can be readily removed while allowing the excess ink removing liquid layer to be kept remaining on the excess ink removing liquid in a both reliable and simple manner.

To allow this method to be carried out in a continual manner, a used portion of the excess ink removing liquid should be removed from the contact surface, and the excess ink removing liquid layer should be replenished with fresh excess ink removing liquid. To prevent the excess ink removing liquid from being rapidly used up, the printing ink dispersed in the used portion of the excess ink removing liquid should be removed therefrom, and the used portion freed from printing ink should be recycled to replenish the excess ink removing liquid layer therewith.

The method of the present invention can be favorably carried out by using a device for post-processing a printed image in a printing device, comprising: coating means for forming a layer of excess ink removing liquid on a contact surface defined by a contact member; contact means for contacting a printed surface of printing paper with the contact surface coated with the excess ink removing liquid layer, the excess ink removing liquid having a property not to mutually dissolve with printing ink forming the printed image, and having a lower surface tension than printing ink deposited on the printed surface; cleaning means for removing the excess ink removing liquid layer after contact with the printed surface; and replenishing means for replenishing fresh excess ink removing liquid onto the contact surface after said excess ink removing liquid is removed by the cleaning means.

According to a preferred embodiment of the present invention, the coating means comprises a excess ink removing liquid supply nozzle for dripping excess ink removing liquid onto the contact surface, and a doctor blade having a free end engaging the contact surface for controlling the thickness of the excess ink removing liquid coated on the contact surface. In this case, the excess ink removing liquid supply nozzle may drip the excess ink removing liquid onto a region of the contact surface trailing a point of contact between the free end of the doctor blade and the contact surface. If the doctor blade is provided with a downward inclination toward the free end thereof, the excess ink removing liquid supply nozzle may drip the excess ink removing liquid onto an upper surface of the doctor blade.

If the doctor blade is provided with a downward inclination from the free end to a base end thereof, the doctor blade may serve also as the cleaning means, and guide the removed excess ink removing liquid along an upper surface of the doctor blade. Preferably, a receiving tray is provided under the base end of the doctor blade to receive the excess ink removing liquid removed from the contact surface and guided by an upper surface of the doctor blade.

To the end of efficiently removing a used portion of the excess ink removing liquid, the cleaning means may comprise a resilient material sheet having a free end engaged to the contact surface, and inclining downward from the free end to a base end thereof, and a receiving tray may be provided under the base end of the resilient material sheet to receive the excess ink removing liquid removed from the contact surface and guided by an upper surface of the resilient material sheet.

According to a particularly preferred embodiment of the present invention, the free end of the doctor blade engages a top portion of the outer circumferential surface of the contact roller or a portion somewhat behind it with respect to the direction of rotation of the contact roller, and the free end of the resilient material sheet engages a portion of the contact surface trailing the free end of the doctor blade. Thus, by dripping excess ink removing liquid in the region of the outer circumferential surface of the contact surface located between the free ends of the doctor blade and the resilient material sheet, a pool of excess ink removing liquid or an excess ink removing liquid storage portion is formed in this region, and the used portion of the excess ink removing liquid can be favorably removed.

Instead of the resilient material sheet, it is possible to use suction means for drawing the used excess ink removing liquid from the contact surface.

BRIEF DESCRIPTION OF THE DRAWINGS

Now the present invention is described in terms of concrete embodiments with reference to the appended drawings, in which.

DETAILED DESCRIPTION OF THE PREFERRED EMBODIMENTS

Figure 1:
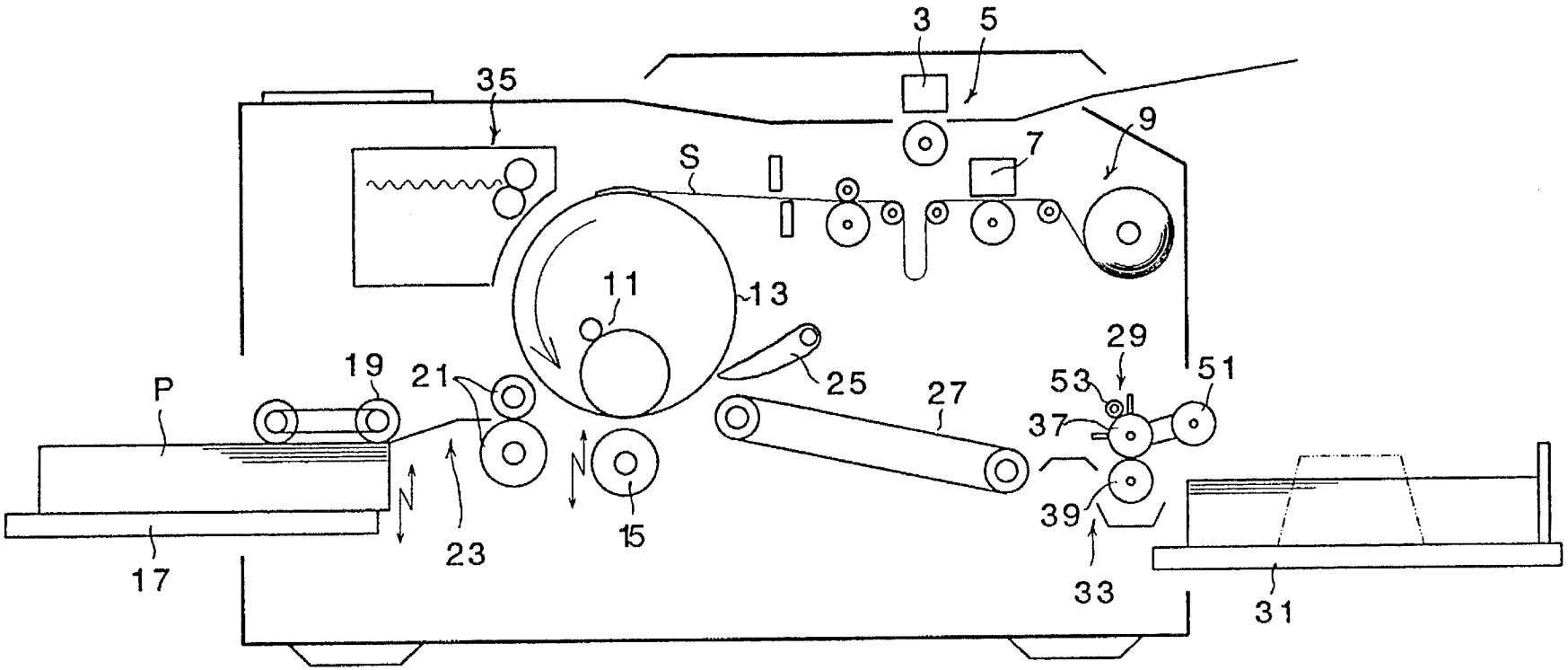
FIG. 1 is a schematic structural view showing an embodiment of the present invention in the form of a stencil printing device to which the printed image post-processing method of the present invention is applied.

FIG. 1 shows an embodiment in the form of a stencil printing device to which the method for post-processing a printed image is applied according to the present invention. The stencil printing device comprises an original image reading unit 5 including an image scanner 3 for reading the image of an original that is to be reproduced by printing, a plate making unit 9 including a thermal head 7 for reproducing the original image according to the original image data acquired by the original image reading unit 5 by thermally perforating a heat-sensitive stencil master plate sheet S, a cylindrical printing drum 13 having the stencil master plate sheet S, processed so as to carry a reproduced image by the plate making unit 9, mounted thereon and internally equipped with a squeegee unit 11, a press roller 15, a paper feed unit 23 which takes out the printing paper P from a paper feed table 17 sheet by sheet by means of paper take out rollers 19 and conveys it to the nip between the printing drum 13 and the press roller 15 by means of paper feed timing rollers 21 at an appropriate timing, a paper ejection unit 33 including peeling claws 25, a belt-conveyer type ejected paper conveying unit 27, a printed image post-processing unit 29, and a paper ejection table 31, and a plate ejection unit 35 for peeling off the used stencil master plate sheet $ from the printing drum 13 and discard it.

In this stencil printing device, the printing drum 13 is rotated in counter clockwise direction around its central axial line by rotary drive means not shown in the drawings, and the printing paper P is conveyed to the nip between the printing drum 13 and the press roller 15 from left to right as seen in FIG. 1 by the paper feed timing roller 21 which is rotatively driven in counter clockwise direction at an appropriate timing in synchronism with the rotation of the printing drum 13. A desired stencil print is made on the printing paper P by the press roller 15 pressing the printing paper P against the stencil master plate sheet S mounted on the outer circumferential surface of the printing drum 13.

The printed printing paper P is peeled off from the printing drum 13 by the peeling claws 25, and is forwarded to the printed image post-processing unit 29 with its printed face up by the ejected paper conveying unit 27. After being processed by the printed image post-processing unit 29, the printing paper P is conveyed to the paper ejection table 31, and is stacked up thereon.

Figure 2:
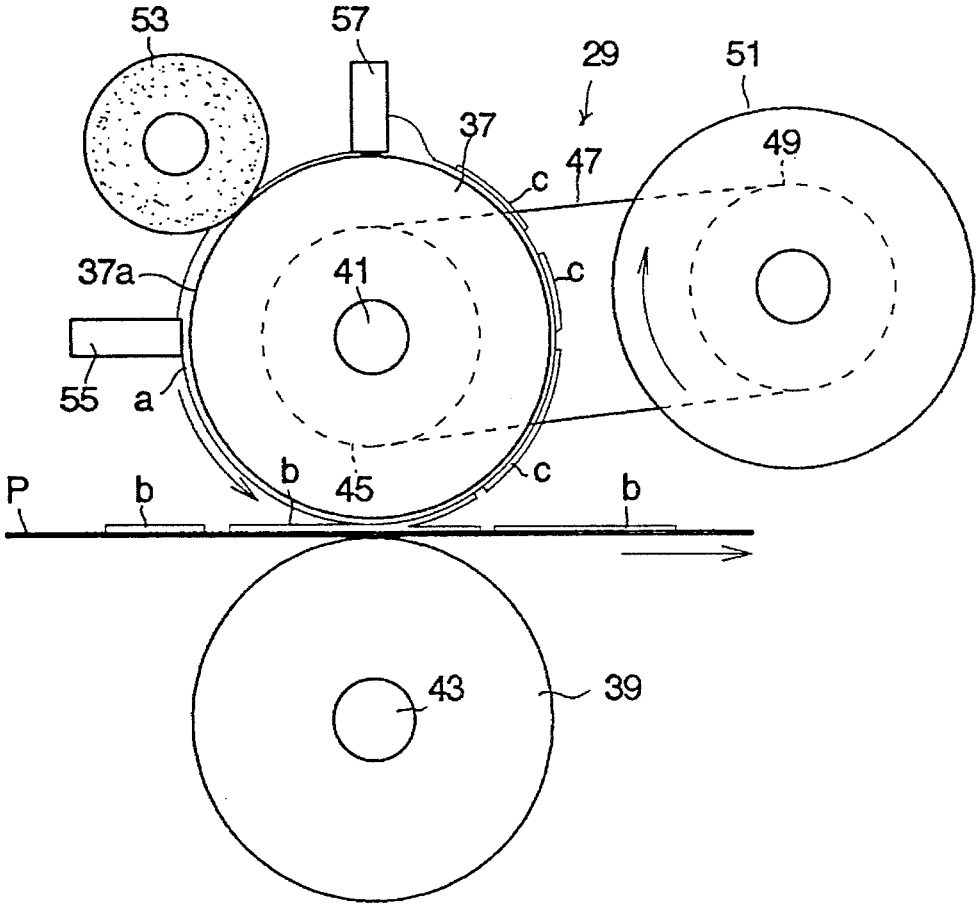
FIG. 2 is a schematic structural view showing an embodiment of the printed image post-processing device according to the present invention.

With reference to FIG. 2, the printed image post-processing unit 29 comprises a contact roller 37 which contacts the printed side (upper surface) of the printed printing paper P, and a counter roller 39 opposing the contact roller 37. These two rollers 37 and 39 are rotatably supported by a pair of shafts 41 and 43 in mutually parallel relationship. The counter roller 39 is biased upward as seen in the drawing or toward the contact roller 37 by a spring not shown in the drawings.

The contact roller 37 is drivingly coupled to a motor 51 via a pulley 45, an endless belt 47, and a pulley 49, and is rotatively driven in counter clockwise direction as seen in FIG. 2.

An excess ink removing liquid coating roller 53 engages the outer circumferential surface (excess ink removing liquid surface) of the contact roller 37. The excess ink removing liquid coating roller 53 is made of foamed synthetic resin material or the like which can be impregnated with excess ink removing liquid, and applies a layer of excess ink removing liquid onto the outer circumferential surface of the contact roller 37.

The excess printing ink removing liquid applied onto the contact roller 37 by the excess ink removing liquid coating roller 53 does not mutually dissolve with the printing ink forming the printed image, and its surface tension is less than that of the printing ink. The liquids which meet such requirements include dimethyl silicone oil, modified silicone oils such as phenyl, polyether, fluoride, amino, epoxy, carboxyl, carbinol, methacryl, melcaptone, and phenol modified silicone oils, and water solutions added with a surface active agent, an organic solvent and so on, and such liquids may be used as the excess printing ink removing liquid.

The surface active agents that may be added to the water solution include anionic, cationic, amphoteric, and nonionic surface active agents, and the amount of the surface active agent that is to be added is determined so that the surface tension of the excess printing ink removing liquid becomes less than that of the printing ink.

The organic solvents that may be added to the water solution should dissolve with water, and may include methanol, ethanol, isopropyl alcohol, n-prolyl alcohol, ethylene glycol, and glycerin.

A doctor blade 55 made of rubber engages the outer circumferential surface 37*a* of the contact roller 37. The doctor blade 55 is located between the excess ink removing liquid coating roller 53 and the counter roller 39 as seen in the direction of rotation of the contact roller, and controls the amount of the excess ink removing liquid on the outer circumferential surface 37*a* of the contact roller 37 so as to form a uniform film a of the excess ink removing liquid on the outer circumferential surface 37*a* of the contact roller 37 which is 0.0001 to 1 μm in thickness. The thickness of the film a of the excess ink removing liquid (excess ink removing liquid layer) may be adjusted so as to be equivalent to 0.1 to 100 mg/B4 paper sheet in terms of the amount of coating on the printing paper.

A cleaning blade 57 made of rubber engages the outer circumferential surface 37*a* of the contact roller 37. The cleaning blade 57 is located between the excess ink removing liquid coating roller 53 and the counter roller 39 as seen in the direction of rotation of the contact roller, and scrapes the outer circumferential surface 37*a* of the contact roller 37.

The contact roller 37, the counter roller 39, the doctor blade 55, and the cleaning blade 57 may be made of materials which are free from adverse influences from the excess ink removing liquid such as swelling, and the contact roller 37, the counter roller 39, the doctor blade 55, and the cleaning blade 57, for instance, may consist of such materials as fluororesin (rubber) and phenyl modified silicone resin (rubber) when the excess ink removing liquid consists of silicone oil.

The outer circumferential surface 37*a* of the contact roller 37 preferably consists of a highly smooth surface having a low coefficient of friction because the doctor blade 55 and the cleaning blade 57 are placed in contact with this surface. Therefore, the outer circumferential surface 37*a* of the contact roller 37 may consist of polytetrafluoroethylene (PTFE), tetrafluoroethylene—hexafluoropropylene copolymer (FEP), and tetrafluoroethylene—fluoroalkylvinylether copolymer (PFA).

According to the stencil printing device equipped with the printed image post-processing device having the above described structure, the printed printing paper P expelled from the printing drum 13 is forwarded, from left to right as seen in FIG. 2, to the nip between the contact roller 37 and the counter roller 39 with its printed image facing up by the ejected paper conveying unit 27.

The printing paper P, interposed between the contact roller 37 and the counter roller 39 from above and below, is positively conveyed in the rightward direction by the counter clockwise rotation of the contact roller 37 caused by the motor 51 as seen in FIG. 2 in synchronism with the rotation of the contact roller 37.

At this point, the contact roller 37 contacts the printed image of the printing paper P via the excess ink removing liquid film a formed around the outer circumferential surface 37*a* of the printing contact roller 37. As a result of this contact, the excess portion of the printing ink b deposited on the printed surface of the printing paper transfers onto the excess ink removing liquid film a on the contact roller 37, and is thereby removed from the printing paper P.

Because the excess ink removing liquid forming the excess ink removing liquid film a does not dissolve with the printing ink b deposited on the printed surface of the printing paper P, and has a surface tension which is less than that of the printing ink c, the printing ink c which has been transferred onto the excess ink removing liquid film a of the printing contact roller 37 remains separated from the excess ink removing liquid, and floats thereon as schematically illustrated in FIG. 2.

The mechanism of the transfer of the printing ink b from the printing paper P to the excess ink removing liquid film a may vary depending on the printing condition, but it is believed that the a layer b of printing ink is separated from the printing ink which was originally deposited on the printing paper as a layer of 1 to 30 μm thick.

Thus, the amount of the transfer of printing ink b to the excess ink removing liquid film a can be controlled by adjusting the time period of contact between the contact roller 37 and the printing paper P, and it can be accomplished by changing the area of contact between the contact roller 37 and the printing paper P through adjustment of the nip width (pressure) between the contact roller 37 and the counter roller 39.

This transfer of printing ink can be also explained by the fact that the wettability of the excess ink removing liquid forming the excess ink removing liquid film a is greater than that of the printing ink itself.

The printing ink c which has been transferred onto the excess ink removing liquid film a is carried to the cleaning blade 57 as the contact roller 37 rotates, and is removed and recovered from the contact roller 37 by being scraped off from the contact roller 37 by the cleaning blade 57.

After the printing ink c is removed from the outer circumferential surface 37*a* of the contact roller 37, the excess ink removing liquid film a is applied onto the outer circumferential surface of the contact roller 37 by the excess ink removing liquid coating roller 53, and an excess ink removing liquid film layer a free from printing ink c is thus reinstated thereon by the doctor blade 55. Because the contact roller 37 contacts the printed image of the printing paper with this newly refreshed excess ink removing liquid film a, the printed surface of the printing paper P would not be contaminated by the printing ink c which was earlier transferred to the contact roller 37.

In this manner, once the printing paper has passed through the nip between the contact roller 37 and the counter roller 39, the excess portion of the printing ink b deposited on the printed surface of the printing paper P is substantially removed. As a result, occurrence of offsetting and strike-through can be avoided, and the printed image would not be smeared even when the printed image is rubbed by a finger or the like immediately after the printing paper is ejected from the printing device. Also, the printing ink b deposited on the printed image can dry up more quickly.

(Embodiment 1)

A device based on the present invention having the structure substantially as illustrated in FIG. 2 is installed in a stencil printing device, Risograph (trademark) RC115D manufactured by Riso Kagaku Kogyo KK, and a stencil printing was carried out by using dimethyl silicone oil KF-96 produced by Shinetsu Kagaku Kogyo KK and having a viscosity of 100 cps, and adjusting the doctor blade 55 so as to control the coated amount of the excess ink removing liquid at the level of 1 mg/B4 size paper.

The results of this printing experiment were evaluated in terms of the performance of the cleaning blade 57 in removing the printing ink c from the contact roller 37 and the uniformity of the application of the excess ink removing liquid on the printing paper P. The results are summarized in Table 1.

(Embodiment 2)

A stencil printing was carried out by using screen printing ink (Riso Screen Ink: Tradename) produced by Riso Kagaku Kogyo KK on a stencil printing device (Print Gokko: Trademark) also manufactured by Riso Kagaku Kogyo KK, and printed sheets of printing paper were passed through a device based on the present invention having the structure substantially as illustrated in FIG. 2. In this embodiment, dimethyl silicone oil was used as the excess ink removing liquid similarly as the case of Embodiment 1, and the same amount of coating was applied as in Embodiment 1. The method of evaluation was also same as that of Embodiment 1. The results of evaluation are summarized in Table 1.

(Embodiment 3)

The same stencil printing device as Embodiment 1 was used, and a stencil printing was carried out by using polyether modified silicone oil KF-351 produced by Shinetsu Kagaku Kogyo KK and having a viscosity of 100 cps as the excess ink removing liquid, and adjusting the doctor blade 55 so as to control the coated amount of the excess ink removing liquid at the level of 10 mg/B4 size paper. The method of evaluation was also same as that of Embodiment 1. The results of evaluation are summarized in Table 1.

(Embodiment 4)

The same stencil printing device as Embodiment 1 was used, and a stencil printing was carried out by using water solution of isopropyl alcohol (isopropyl alcohol/water=1/9) as the excess ink removing liquid, and adjusting the doctor blade 55 so as to control the coated amount of the excess ink removing liquid at the level of 1 mg/B4 size paper. The method of evaluation was also same as that of Embodiment 1. The results of evaluation are summarized in Table 1.

(Example for Comparison 1)

The same stencil printing device and the same excess ink removing liquid as Embodiment 1 were used, and a stencil printing was carried out by adjusting the doctor blade 55 so as to control the coated amount of the excess ink removing liquid at the level of 0.01 mg/B4 size paper. The method of evaluation was also same as that of Embodiment 1. The results of evaluation are summarized in Table 1.

(Example for Comparison 2)

The same stencil printing device and the same excess ink removing liquid as Embodiment 1 were used, and a stencil printing was carried out by adjusting the doctor blade 55 so as to control the coated amount of the excess ink removing liquid at the level of 500 mg/B4 size paper. The method of evaluation was also same as that of Embodiment 1. The results of evaluation are summarized in Table 1.

(Example for Comparison 3)

The same stencil printing device as Embodiment 1 was used, and a stencil printing was carried out by using alkyl modified silicone oil KF-413 (which dissolve with the resin used in the printing ink) produced by Shinetsu Kagaku Kogyo KK and having a viscosity of 100 cps as the excess ink removing liquid, and adjusting the doctor blade 55 so as to control the coated amount of the excess ink removing liquid at the level of 10 mg/B4 size paper. The method of evaluation was also same as that of Embodiment 1. The results of evaluation are summarized in Table 1.

(Example for Comparison 4)

The same stencil printing device as Embodiment 1 was used, and a stencil printing was carried out by using water (tap water) as the excess ink removing liquid, and adjusting the doctor blade 55 so as to control the coated amount of the excess ink removing liquid at the level of 1 mg/B4 size paper. The method of evaluation was also same as that of Embodiment 1. The results of evaluation are summarized in Table 1.

TABLE 1

| | removing capability | coating uniformity |
|---|---|---|
| Embodiment 1 | O | O |
| Embodiment 2 | O | O |
| Embodiment 3 | O | O |
| Embodiment 4 | O | O |
| Exmpl. for Comp. 1 | X | O |
| Exmpl. for Comp. 2 | O | X |
| Exmpl. for Comp. 3 | X | O |
| Exmpl. for Comp. 4 | X | O |

(Method of Evaluation)

Removing capability:

O: The printing ink transferred onto the contact roller 37 was sufficiently removed by the cleaning blade 57, and the transferred printing ink was prevented from being deposited again on the printing paper.

X: The printing ink transferred onto the contact roller 37 was not sufficiently removed by the cleaning blade 57, and part of the transferred printing ink was again deposited on the printing paper, thus smearing the printing paper.

Coating uniformity:

O: No coating unevenness

X: Some coating unevenness

In the above described embodiment, the cleaning blade 57 trailed the excess ink removing liquid coating roller 53 as seen in the direction of rotation of the contact roller 37, but may also lead the excess ink removing liquid coating roller 53 as the doctor blade 55 does. In the latter case, the doctor blade 55 may also serve as the cleaning blade 57.

If other excess ink removing liquid coating means can be used for evenly coating the excess ink removing liquid on the outer circumferential surface of the contact roller 37 at a prescribed thickness, it is possible to eliminate the doctor blade 55.

Also, by incorporating the printed image post-processing device 29 into the stencil printing device in such a manner as to serve as ejected paper conveying means using a pair of rollers, it is possible to eliminate the need for the ejected paper conveying unit 27.

Figure 3:
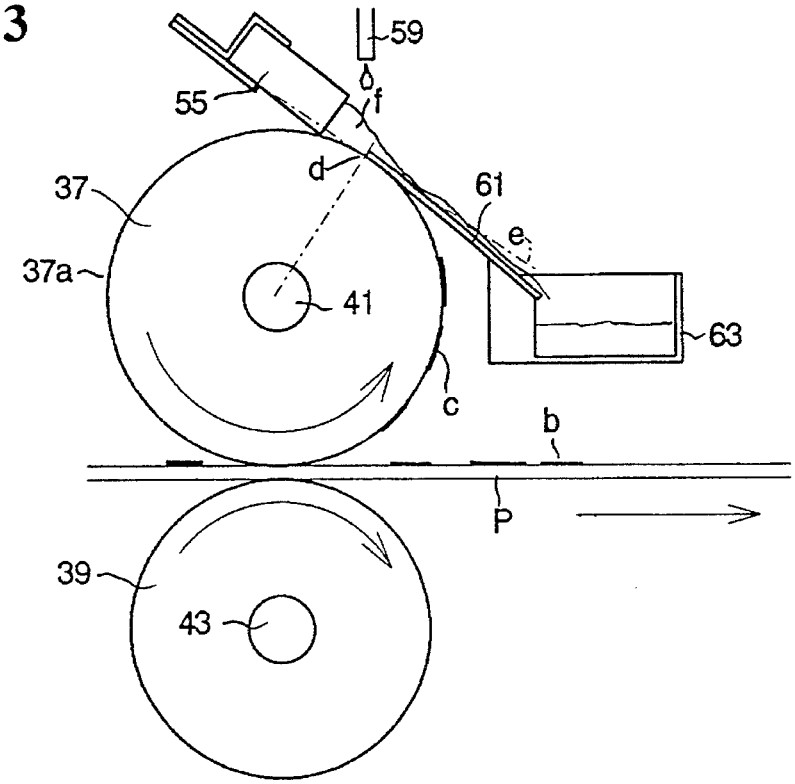
FIG. 3 is a schematic structural view showing another embodiment of the printed image post-processing device according to the present invention which includes a resilient material sheet for removing used excess ink removing liquid.

FIG. 3 shows another embodiment of the printed image post-processing device 29. In FIG. 3, the parts corresponding to those of FIG. 2 are denoted with like numerals. In this embodiment, the doctor blade 55 also serves as a cleaning blade, and an excess ink removing liquid supply nozzle 59 is provided for dripping the excess ink removing liquid on a part of the outer circumferential surface 37*a* of the contact roller 37 located behind the position of contact between the doctor blade 55 and the contact roller 37.

The doctor blade 55 is located in the vicinity of the upper end (or slightly trailing the top of the roller) in an inclined orientation, and a sheet of resilient material 61 is placed in a location trailing the position of contact between the doctor blade 55 and the contact roller 37 as seen in the direction of rotation of the contact roller 37 for recovering the excess ink removing liquid.

The resilient material sheet 61 consists of a sheet material made of polyethylene terephthalate film, polypropylene film, synthetic paper or the like which would not swell by contact with the excess ink removing liquid. The resilient material sheet 61, which is approximately 10 to 300 μm in thickness, and has an average bending rigidity in the order of 0.001 to 10.0 $g \cdot cm^2/cm$ (measured by a pure bending testing machine made by KK Nihon Seiki Seisakusho), engages the outer circumferential surface 37*a* of the contact roller 37.

The resilient material sheet 61 inclines downward from the point of contact with the outer circumferential surface 37*a* of the contact roller 37, and is supported by an excess ink removing liquid receiving tray 63 at its lower end in such a manner that the free end of the resilient material sheet 61 engages the contact roller 37.

The resilient material sheet 61 has a region of contact d with the outer circumferential surface 37*a* of the contact roller 37 which is closer to the outer circumferential surface 37*a* of the contact roller 37 than a tangential line e, and thus contacts the outer circumferential surface 37*a* of the contact roller 37 over a certain length thereof by undergoing an elastic deformation conforming to the outer circumferential surface 37*a* of the contact roller 37.

According to such a structure, the excess ink removing liquid is dripped onto the outer circumferential surface 37*a* of the contact roller 37 from the excess ink removing liquid supply nozzle 59, and as the contact roller 37 rotates in counter clockwise direction the doctor blade 55 forms a film of excess ink removing liquid over the outer circumferential surface 37*a* of the contact roller 37 at the thickness of 0.0001 to 1 μm.

In this case also, as the printed printing paper P is fed from left as seen in FIG. 3 by the roller pair consisting of the contact roller 37 and the counter roller 39 with its printed surface facing up, the printing paper P is conveyed to the right as seen in the drawing in synchronism with the rotation of the contact roller 37. The contact roller 37 thus contacts the printed surface with the excess ink removing liquid film formed over the outer circumferential surface 37*a* of the contact roller 37. This contact causes an excess portion of the printing ink b which forms the printed image on the printed surface to be transferred onto the excess ink removing liquid film of the contact roller 37, and to be thereby removed from the printing paper P.

As the contact roller 37 rotates, the printing ink c which has been transferred onto the excess ink removing liquid film formed over the contact roller 37 passes through the point of contact between the resilient material sheet 61 and the contact roller 37 without encountering any substantial resistance from this point of contact, and is scraped off by the action of the doctor blade 55. As a result, a pool of excess ink removing liquid or an excess ink removing liquid storage portion f containing an excessive portion of the excess ink removing liquid and the printing ink c in a dispersed condition is produced on a portion of the contact roller 37 which trails the point of contact between the doctor blade 55 and the outer circumferential surface 37*a* of the contact roller 37.

Because the point of contact between the doctor blade 55 and the outer circumferential surface 37*a* of the contact roller 37 trails the top of the contact roller 37, once the excess ink removing liquid in the excess ink removing liquid storage portion f exceeds a certain level, even though the contact roller 37 continues to rotate, the excess ink removing liquid in the excess ink removing liquid storage portion f starts to sag and flow in the opposite direction to the rotational direction of the contact roller 37 under the action of its own weight. The flow of the excess ink removing liquid is received by the resilient material sheet 61, and is guided downward along the inclined upper surface of the resilient material sheet 61 to be eventually dropped into and recovered by the receiving tray 63 under the action of the gravity.

The resilient material sheet 61 is relatively free from accumulation of residual printing ink deposits arising from the printing ink dispersed in the excess ink removing liquid because of the property of the 10 material of which the resilient material sheet 61 is made. To further ensure this, the surface of the resilient material sheet 61 may be coated with polytetrafluoroethylene (PTFE), tetrafluoroethylene—hexafluoropropylene copolymer (FEP), or tetrafluoroethylene—fluoroalkylvinylether copolymer (PFA).

(Embodiment 5)

A device based on the present invention having the structure substantially as illustrated in FIG. 3 is installed in a stencil printing device, Risograph (trademark) RC115D manufactured by Riso Kagaku Kogyo KK. The contact roller 37 is prepared by coating polytetrafluoroethylene film over the outer circumferential surface 37*a* of an aluminum roller, and buffing the outer surface. The resilient material sheet 61 consisted of polyethylene terephthalate film which is approximately 50 μm in thickness, and has a bending rigidity of approximately ±0.003 g·cm$^2$/cm.

The excess ink removing liquid consisted of dimethyl silicone oil KF-96 produced by Shinetsu Kagaku Kogyo KK and having a viscosity of 100 cps. A stencil printing was carried out so as to control the coated amount of the excess ink removing liquid at the level of 1 mg/B4 size paper by adjusting the doctor blade 55.

The results of this printing experiment were evaluated by observing if the region of contact between the resilient material sheet 61 and the contact roller 37 is contaminated by the printing ink carried by the excess ink removing liquid film, and if the excess ink removing liquid containing the printing ink is fully recovered by the receiving tray 63 placed under the resilient material sheet 61. The results are summarized in Table 2.

(Embodiments 6 through 12)

The same device as Embodiment 5 was used, and the same method of evaluation as Embodiment 5 was used on various resilient material sheets 61 consisting of different materials, and having different thicknesses and average bending rigidities for different Embodiments. The materials, thicknesses and average bending rigidities of these resilient material sheets are summarized in Table 2.

In Table 2, PET and PP stand for polyethylene terephthalate and polypropylene film, respectively, and the synthetic paper was the one manufactured and marketed by Ojiyuka Goseishi KK under the tradename of Yupo.

(Examples for Comparison 5)

The same device as Embodiment 5 was used, and the same method of evaluation as Embodiment 5 was used under the same conditions except for that polyethylene terephthalate having a thickness of 10 μm and an average bending rigidity of approximately ±0.003 g·cm$^2$/cm was used. The results of evaluation are summarized in Table 2.

(Examples for Comparison 6 through 8)

The same device as Embodiment 5 was used, and the same method of evaluation as used in Embodiment 5 was used on a resilient material sheet 61 consisting of different material and having different thickness and average bending rigidity for each Embodiment. The material, thickness, and average bending rigidity of the resilient sheet material for each Embodiment are summarized in Table 2.

TABLE 2

| Embd No. | material | thick -ness (μm) | avg. bending rigidity (g · cm$^2$/cm) | smear | recovering performance |
|---|---|---|---|---|---|
| 5 | PET | 12.5 | ±0.003 | O | O |
| 6 | PET | 100 | ±1.980 | O | O |
| 7 | PET | 125 | ±3.990 | O | O |
| 8 | PET | 150 | ±7.510 | O | O |
| 9 | synth. paper | 140 | ±2.160 | O | O |
| 10 | synth. paper | 200 | ±3.140 | O | O |
| 11 | PP | 25 | ±0.002 | O | O |
| 12 | PP | 40 | ±0.054 | O | X |
| 5* | PET | 10 | ±0.001 | O | O |
| 6* | synth. paper | 188 | ±11.900 | X | O |
| 7* | PP | 400 | ±12.800 | X | O |
| 8* | PP | 12.5 | ±0.000 | O | X |

note) 5* through 8* are examples for comparison.

(Method of Evaluation)

Smear test:

O: The excess ink removing liquid containing printing ink passed through the region of contact between the resilient material sheet 61 and the contact roller 37 without any problem.

X: The excess ink removing liquid containing printing ink was partly scraped off by the resilient material sheet 61 in the region of contact between the resilient material sheet 61 and the contact roller 37, the thus scraped-off excess ink removing liquid flowing down along the resilient material sheet 61, and the free end of the resilient material sheet was smeared by the printing ink.

Recovering performance:

O: The excess ink removing liquid containing printing ink passed through the region of contact between the resilient material sheet 61 and the contact roller 37 without any problem, and was safely received in the receiving tray 63 provided in the excess ink removing liquid storage portion f.

X: The excess ink removing liquid containing printing ink passed through the region of contact between the resilient material sheet 61 and the contact roller 37, but was not recovered by the receiving tray 63 provided in the excess ink removing liquid storage portion f.

Figure 4:
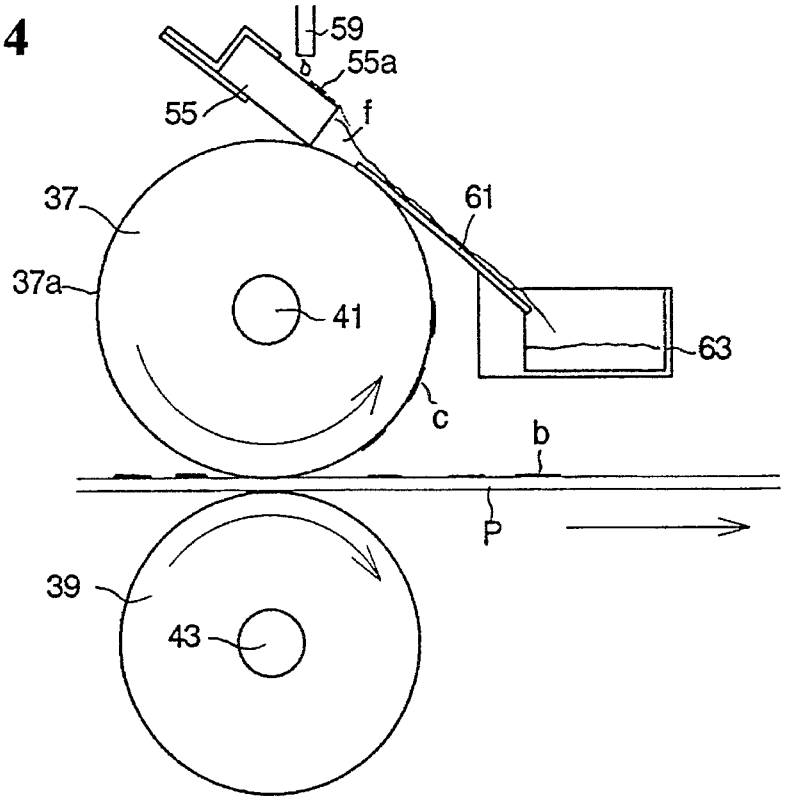
FIG. 4 is a schematic structural view showing yet another embodiment of the printed image post-processing device according to the present invention.

In the embodiment illustrated in FIG. 3, the excess ink removing liquid supplying nozzle 59 directly dripped the excess ink removing liquid onto the region of the outer circumferential surface 37*a* of the contact roller 37 trailing the point of contact between the doctor blade 55 and the contact roller 37. However, the excess ink removing liquid supplying nozzle 59 may also drip the excess ink removing liquid onto the inclined upper surface 55*a* of the doctor blade 55 as illustrated in FIG. 4.

In this case, the excess ink removing liquid drips from the excess ink removing liquid supplying nozzle 59 onto the inclined upper surface 55*a* of the doctor blade 55, and drops onto the outer circumferential surface 37*a* of the contact roller 37 while expanding in the axial direction of the contact roller 37 guided by the inclined upper surface 55*a*.

Thus, the uniformity in the distribution of the excess ink removing liquid in the axial direction can be improved.

Figure 5:
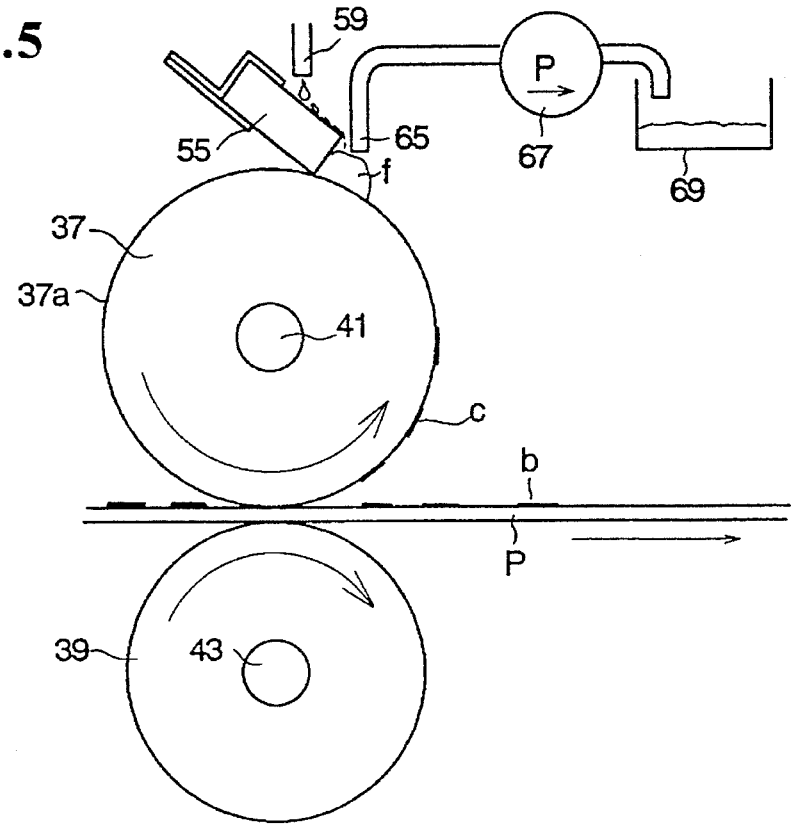
FIG. 5 is a schematic structural view showing yet another embodiment of the printed image post-processing device according to the present invention which uses suction means for removing used excess ink removing liquid.

FIG. 5 shows yet another embodiment of the printed image post-processing device 29. In FIG. 5, the parts corresponding to those in FIGS. 2 and 3 are denoted with like numerals.

In this embodiment, a suction nozzle 65 is provided above the excess ink removing liquid storage portion f. The suction nozzle 65 opens toward the outer circumferential surface 37*a* of the contact roller 37 at a position higher than the outer circumferential surface 37*a* by a prescribed distance in the excess ink removing liquid storage portion f, and communicates with a suction port of a suction gear pump 67. The outlet port of the suction pump 67 is connected to a recovered liquid tank 69.

The suction gear pump 67 may be actuated at all times, and when the liquid level in the excess ink removing liquid storage portion f reaches the open end of the suction nozzle 65, the excess ink removing liquid of the excess ink removing liquid storage portion f is drawn by the suction nozzle 65 so as to be recovered to the recovered liquid tank 69 by the suction gear pump 67.

Figure 6:
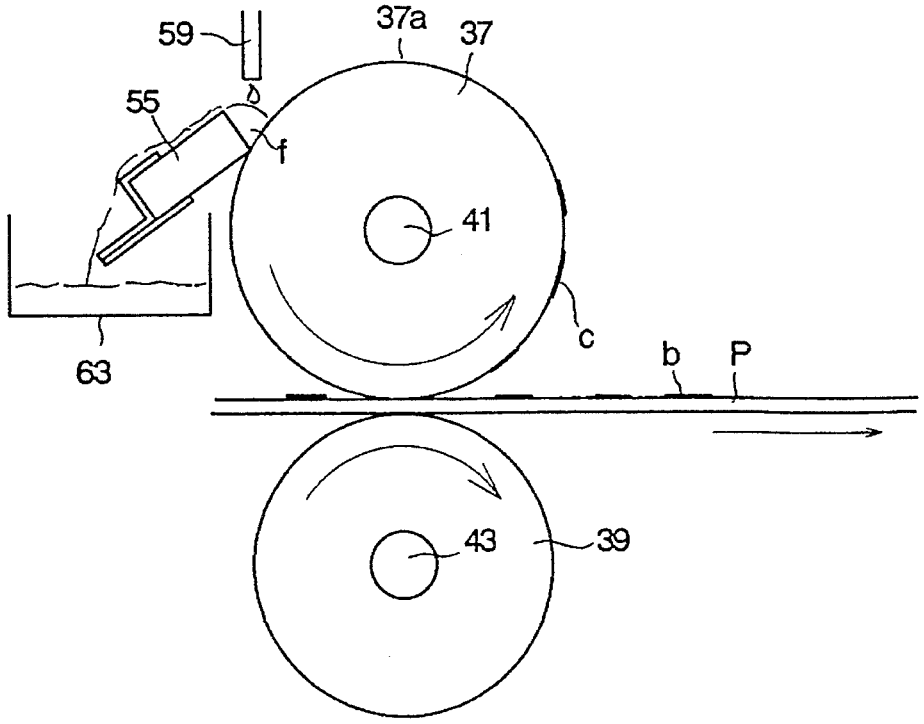
FIG. 6 is a schematic structural view showing still yet another embodiment of the printed image post-processing device according to the present invention in which the doctor blade serves also as cleaning means for removing used excess ink removing liquid.

FIG. 6 shows yet another embodiment of the printed image post-processing device 29. In FIG. 6, the parts corresponding to those in FIGS. 2 and 3 are denoted with like numerals.

In this embodiment, the doctor blade 55 engages the outer circumferential surface 37*a* of the contact roller 37 with a downward inclination, and a receiving tray 63 is placed under the doctor blade 55.

In this embodiment also, an excess ink removing liquid storage portion f is formed in the region of contact between the doctor blade 55 and the outer circumferential surface 37*a* of the contact roller 37, and the excess ink removing liquid in the excess ink removing liquid storage portion f flows over the upper edge of the doctor blade 55 and flows down along the inclined upper surface of the doctor blade 55 under the action of the gravity before it is eventually received by the receiving tray 63.

Figure 7:
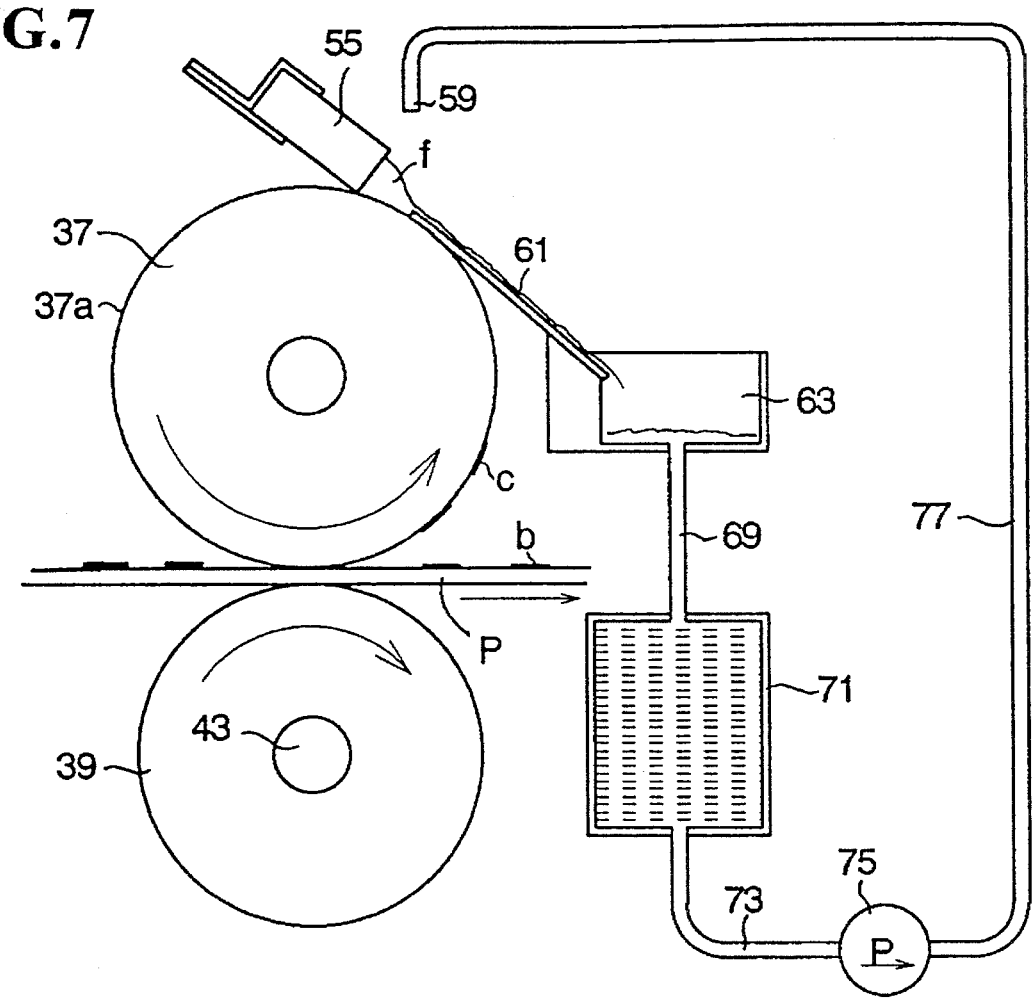
FIG. 7 is a schematic structural view showing still yet another embodiment of the printed image post-processing device according to the present invention which include a filter for recycling the used excess ink removing liquid by eliminating printing ink dispersed in the used excess ink removing liquid therefrom.

FIG. 7 shows yet another embodiment of the printed image post-processing device 29. In FIG. 7, the parts corresponding to those in FIGS. 2 and 3 are denoted with like numerals.

In this embodiment, the receiving tray 63 is communicated with an inlet port of a filter 71 by a conduit 69. The filter 71 may consist of a laminated assembly of one or a combination of filter paper, non-woven fabric, fabric and gauze, and catches the printing ink dispersed in the excess ink removing liquid while permitting the flow of only the excess ink removing liquid for the purpose of reviving the excess ink removing liquid.

The outlet port of the filter 71 is communicated with the suction port of an excess ink removing liquid supply pump 75 by a conduit 73 while the outlet port of the excess ink removing liquid supply pump 75 is directly communicated with the excess ink removing liquid supply pump 75 by a conduit 77.

In this embodiment, the excess ink removing liquid recovered by the receiving tray 63 is forwarded to the filter 71 to have the printing separated by the filter 71, and the excess ink removing liquid thus made free from printing ink and revived is supplied to the excess ink removing liquid supply nozzle 59 by the excess ink removing liquid supply pump 75 for reuse.

(Embodiment 13)

A device based on the present invention having the structure substantially as illustrated in FIG. 7 was installed in a stencil printing device, Risograph (trademark) RC115D manufactured by Riso Kagaku Kogyo KK. The contact roller 37 was prepared by coating polytetrafluoroethylene film over the outer circumferential surface of an aluminum roller, and buffing the outer surface. The resilient material sheet 61 consisted of polyethylene terephthalate film which is approximately 50 μm in thickness, and has an average bending rigidity of approximately ±0.003 $g \cdot cm^2/cm$. The filter 71 consisted of a laminated assembly of non-woven fabric primarily composed of polyethylene terephthalate fibers and having a density of 300 $g/cm^2$ and a thickness of 10 mm.

The excess ink removing liquid consisted of dimethyl silicone oil KF-96 produced by Shinetsu Kagaku Kogyo KK and having a viscosity of 100 cps. A stencil printing was carried out so as to control the coated amount of the excess ink removing liquid at the level of 1 mg/B4 size paper by adjusting the doctor blade 55.

The printing ink dispersed in the excess ink removing liquid as fine particles is caught by the filter 71, and the excess ink removing liquid which passed through the filter was reused. The reused excess ink removing liquid was capable of removing excess printing ink on the printing paper substantially in the same way as new excess ink removing liquid.

(Example for Comparison 9)

When the excess ink removing liquid was reused using the same device as Embodiment 13 except for absence of the filter 71 in this case, smudges were produced in the printing paper by contact with the contact roller 37.

Figure 8:
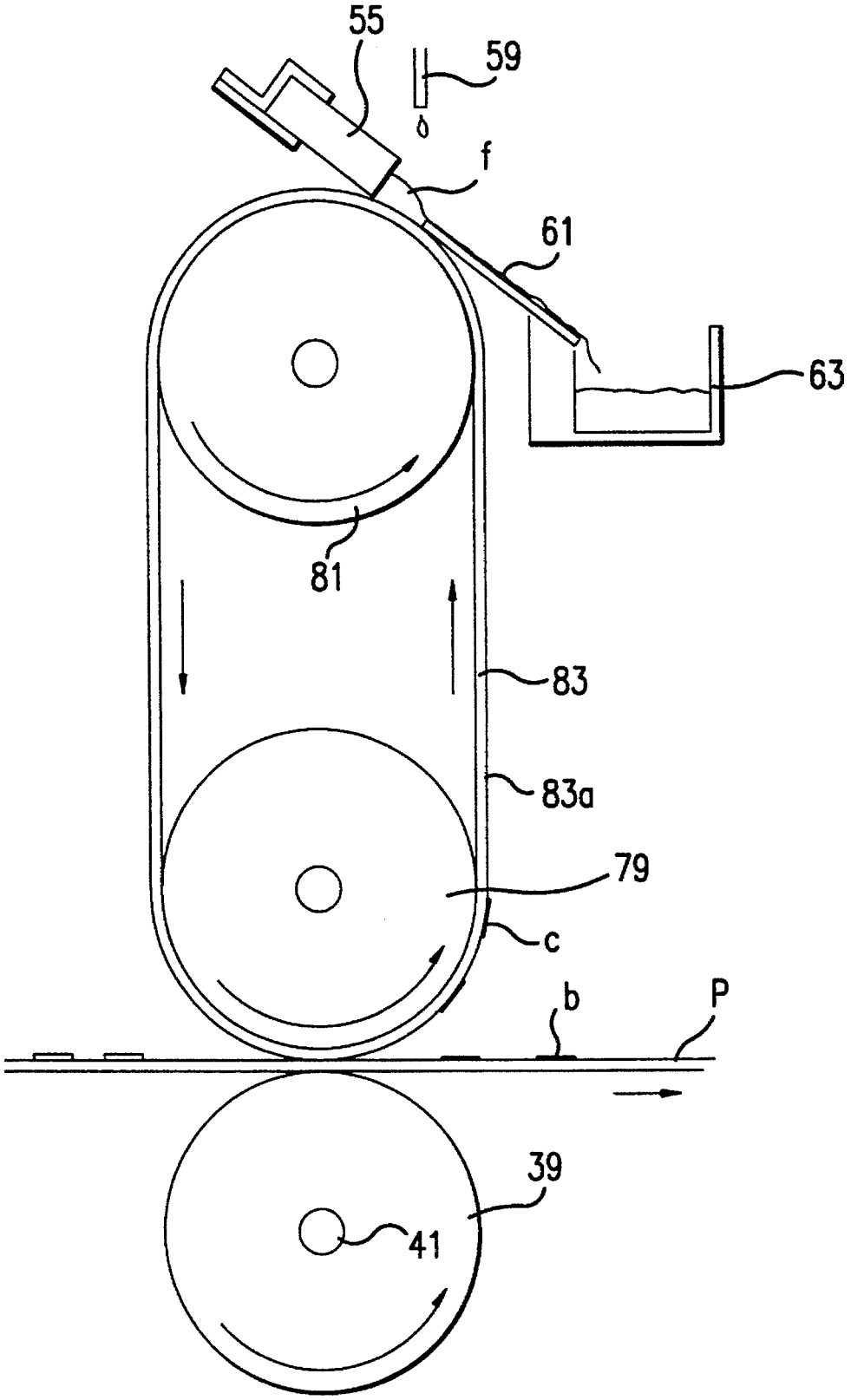
FIG. 8 is a schematic structural view showing still yet another embodiment of the printed image post-processing device according to the present invention using an endless contact belt to define a contact surface.

FIG. 8 shows yet another embodiment of the printed image post-processing device 29. In FIG. 8, the parts corresponding to those in FIGS. 2 and 3 are denoted with like numerals.

In this embodiment, a resilient endless belt 83 was passed around a pair of rollers 79 and 81 under a prescribed tension, and the roller 81 is rotatively driven in counter clockwise direction by a motor not shown in the drawing.

The endless belt 83 may be made of arbitrary material, but may preferably have a smooth surface layer having a low frictional coefficient similarly as the outer circumferential surface of the contact roller 37 and made of such material as polytetrafluoroethylene (PTFE), tetrafluoroethylene—hexafluoropropylene copolymer (FEP), and tetrafluoroethylene—fluoroalkylvinylether copolymer (PFA). The endless belt 83 opposes a counter roller 39 where it is passed around the lower roller 79, and the printing paper P is passed through the nip between the endless belt 83 and the counter roller 39 with its printed surface up.

In the region of the endless belt 83 where it is passed around the upper roller 81, a doctor blade 55 serving also as a cleaning blade engages a point near the upper end of the upper roller 81 in the same way as the embodiment illustrated in FIG. 2. The excess ink removing liquid which is dripped onto the outer belt surface 83*a* of the endless belt 83 forms a film of excess ink removing liquid (excess ink removing liquid coated surface).

The resilient material sheet 61 inclines downward from the point of contact with the outer belt surface 83*a* of the endless belt 83, and is supported by an excess ink removing liquid receiving tray 63 at its lower end in such a manner that the free end of the resilient material sheet 61 engages the outer belt surface 83*a*.

According to such a structure, the excess ink removing liquid is dripped onto the outer belt surface 83*a* of the endless belt 83 by the excess ink removing liquid supply nozzle 59, and as the endless belt 83 undergoes a circulating movement actuated by the counter clockwise rotation of the roller 81, a excess ink removing liquid film having a thickness in the order of 0.0001 to 1 μm is formed on the outer belt surface 83*a* of the endless belt 83 by virtue of the doctor blade 55.

In this case also, as the printed printing P is fed from left as seen in FIG. 8 through the nip between the part of the endless belt 83 passed around the roller 79 and the counter roller 39 with its printed surface facing up, the printing paper P is conveyed to the right as seen in the drawing in synchronism with the rotation of the circulating movement of the endless belt 83. The endless belt 83 thus contacts the printed surface with the excess ink removing liquid film formed over the outer belt surface 83a of the endless belt 83. This contact causes an excess portion of the printing ink b which forms the printed image on the printed surface to be transferred onto the excess ink removing liquid film of the endless belt 83, and to be thereby removed from the printing paper P.

As the endless belt 83 undergoes a circulating movement, the printing ink which has been transferred onto the excess ink removing liquid film passes through the point of contact between the resilient material sheet 61 and the endless belt 83 without encountering any substantial resistance from this point of contact, and is scraped off by the action of the doctor blade 55. As a result, a pool of excess ink removing liquid or an excess ink removing liquid storage portion f containing an excessive portion of the excess ink removing liquid and the printing ink in a dispersed condition is produced on a portion of the endless belt 83 which trails the point of contact between the doctor blade 55 and the outer belt surface 83a of the endless belt 83.

When the liquid level in the excess ink removing liquid storage portion f exceeds a prescribed level, even when the endless belt 83 is moving, the excess ink removing liquid in the excess ink removing liquid storage portion f starts flowing under the action of the gravity in the opposite direction to the rotational direction of the roller 81. This flow of excess ink removing liquid is received by the resilient material sheet 61, and flows along the inclined upper surface of the resilient material sheet 61 under the action of the gravity before the excess ink removing liquid is recovered by the receiving tray 63.

The resilient material sheet may alternatively be provided in association with the cleaning blade 57.

The method and the device for post-processing a printed image according to the present invention can be applicable not only to stencil printing but also to other modes of printing such as offset printing. Effect of the Invention is as can be understood from the above description, according to the method and the device for post-processing a printed image in a printing device, the contact roller engages the printed surface of the printing paper with the excess ink removing liquid layer formed around its outer circumferential surface, and this contact causes the excess portion of the printing ink deposited on the printed image of the printing paper to be transferred onto the excess ink removing liquid layer of the contact roller so as to remove the excess ink from the printing paper. Therefore, the occurrence of offsetting and strike-through can be positively avoided without creating any new problems, and the printed image would not be smeared even when the printed image is touched by a finger or the like immediately after the printing paper is ejected.

Also, because the printing paper can be positively conveyed by a pair of rollers consisting of the contact roller and the counter roller, the printing paper can be neatly stacked on a paper ejection tray and a sorter by virtue of the accurate conveying action for the printing paper, and the freedom of design of the path for conveying the printing paper can be expanded as compared to the prior art.

Because the excess ink removing liquid forming the excess ink removing liquid layer consists of a liquid which does not dissolve with the printing ink forming the printed image and has smaller surface tension than the printing ink, the printing ink which has been transferred to the excess ink removing liquid layer remains physically separated from the excess ink removing liquid and floats therein. Therefore, the cleaning means which scrapes off the transferred printing ink from the outer circumferential surface of the contact roller by engaging its outer circumferential surface can remove the transferred printing ink in a both reliable and simple manner, and the contact roller would not smear the printed image of the printing paper.

Because the excess ink removing liquid remaining in a portion trailing the region of contact between the cleaning means or the doctor blade and the excess ink removing liquid coated surface with respect to the direction of movement of the excess ink removing liquid coated surface is removed by a resilient material sheet or suction means, and is recovered by a receiving tray, a stable printed image post-processing can be carried out over an extended time period simply by expelling the excess ink removing liquid recovered by the receiving tray.

Furthermore, by, reviving the excess ink removing liquid recovered by the excess ink removing liquid recovering means with the filter for reuse, the consumption of the excess ink removing liquid can be reduced, and the running cost can be thereby reduced. Additionally, the work required for expelling the excess ink removing liquid recovered by the receiving tray can be eliminated.

Although the present invention has been described in terms of a specific embodiment thereof, it is possible to modify and alter details thereof without departing from the spirit of the present invention.

What we claim is:

1. A method for post-processing a printed image in a printing device, comprising the steps of:

coating a layer of excess ink removing liquid on a contact surface of a contact member;

contacting a printed surface of printing paper with said contact surface coated with said excess ink removing liquid layer, said excess ink removing liquid having a property not to mutually dissolve with printing ink forming said printed image, and having a lower surface tension than printing ink deposited on said printed surface; and removing excess printing ink from said printed surface by transferring an excess portion of said printing ink deposited on said printed surface onto said excess ink removing liquid layer coated on said contact surface.

2. A method for post-processing a printed image in a printing device according to claim 1, wherein said contact surface is defined by an outer circumferential surface of a contact roller, and said excess ink removing liquid layer formed on said outer circumferential surface of said contact roller is brought into contact with said printed surface of said printing paper by passing said printing paper through a nip between said contact roller and a counter roller opposing said contact roller.

3. A method for post-processing a printed image in a printing device according to claim 1, wherein said contact surface is defined by an outer belt surface of an endless belt passed around a plurality of rollers, and said excess ink removing liquid layer formed on said belt surface of said endless belt: is brought into contact with said printed image surface of said printing paper by passing said printing paper through a nip between said endless belt and a counter roller opposing said endless belt.

4. A method for post-processing a printed image in a printing device according to claim 1, further comprising the step of removing a used portion of said excess ink removing liquid from said contact surface, and replenishing said excess ink removing liquid layer with fresh excess ink removing liquid.

5. A method for post-processing a printed image in a printing device according to claim 4, further comprising the step of removing printing ink dispersed in said used portion of said excess ink removing liquid therefrom, and recycling said used portion freed from printing ink to replenish said excess ink removing liquid layer therewith.

6. A device for post-processing a printed image on a printing paper in a printing device, comprising:

means for providing a layer of excess ink removing liquid;

a contact member defining a contact surface;

coating means for forming said layer of excess ink removing liquid on said contact surface defined by said contact member;

contact means for contacting a printed surface of said printing paper with said contact surface coated with said excess ink removing liquid layer, said excess ink removing liquid having a property not to mutually dissolve with printing ink forming said printed image, and having a lower surface tension than printing ink deposited on said printed surface;

cleaning means for removing said excess ink removing liquid layer after contact with said printed surface; and replenishing means for replenishing fresh excess ink removing liquid onto said contact surface after said excess ink removing liquid is removed by said cleaning means.

7. A device for post-processing a printed image in a printing device according to claim 6, wherein said contact surface comprises an outer circumferential surface of a contact roller having a substantially horizontal axis of rotation, and said contact means comprises a counter roller opposing said contact roller, and means for rotatively actuating at least one of said contact roller and said counter roller, said printed surface of said printing paper being brought into contact with said contact surface by said printing paper being passed through a nip defined between said contact roller and said counter roller.

8. A device for post-processing a printed image in a printing device according to claim 6, wherein said contact surface comprises an outer belt surface of an endless contact belt, and a plurality of guide rollers having substantially horizontal axes of rotation and passing around said endless contact belt, and said contact means comprises a counter roller opposing said endless contact belt, and means for rotatively actuating at least one of said guide rollers and said counter roller, said printed surface of said printing paper being brought into contact with said contact surface by said printing paper being passed through a nip defined between said endless contact belt and said counter roller.

9. A device for post-processing a printed image in a printing device according to claim 6, further comprising filter means for separating printing ink from said removed excess ink removing liquid, and using said removed excess ink removing liquid separated from said printing ink as said fresh excess ink removing liquid to be replenished onto said contact surface.

10. A device for post-processing a printed image in a printing device according to claim 6, wherein said coating means comprises a excess ink removing liquid supply nozzle for dripping excess ink removing liquid onto said contact surface, and a doctor blade having a free end engaging said contact surface for controlling the thickness of said excess ink removing liquid coated on said contact surface.

11. A device for post-processing a printed image in a printing device according to claim 10, wherein said excess ink removing liquid supply nozzle drips said excess ink removing liquid onto a region of said contact surface trailing a point of contact between said free end of said doctor blade and said contact surface.

12. A device for post-processing a printed image in a printing device according to claim 10, wherein said doctor blade is provided with a downward inclination toward said free end thereof, and said excess ink removing liquid supply nozzle drips said excess ink removing liquid onto an upper surface of said doctor blade.

13. A device for post-processing a printed image in a printing device according to claim 11, wherein said doctor blade also serves as said cleaning means, and is provided with a downward inclination from said free end to a base end thereof to guide said removed excess ink removing liquid along an upper surface of said doctor blade.

14. A device for post-processing a printed image in a printing device according to claim 13, further comprising a receiving tray provided under said base end of said doctor blade to receive said excess ink removing liquid removed from said contact surface and guided by an upper surface of said doctor blade.

15. A device for post-processing a printed image in a printing device according to claim 11, wherein said cleaning means comprises a resilient material sheet having a free end engaged to said contact surface, and inclining downward from said free end to a base end thereof.

16. A device for post-processing a printed image in a printing device according to claim 15, further comprising a receiving tray provided under said base end of said resilient material sheet to receive said excess ink removing liquid removed from said contact surface and guided by an upper surface of said resilient material sheet.

17. A device for post-processing a printed image in a printing device according to claim 15, wherein said free end of said doctor blade engages a top portion of said outer circumferential surface of said contact roller or a portion somewhat behind it with respect to the direction of rotation of said contact roller.

18. A device for post-processing a printed image in a printing device according to claim 17, wherein said free end of said resilient material sheet engages a portion of said contact surface trailing said free end of said doctor blade.

19. A device for post-processing a printed image in a printing device according to claim 11, wherein said cleaning means comprises suction means for drawing said used excess ink removing liquid from said contact surface.

20. A device for post-processing a printed image in a printing device according to claim 9, wherein said filter means consists of a member or a combination of members selected from a group consisting of filter paper, no-woven fabric, fabric, and gauze.

* * * * *